US010500516B1

(12) United States Patent
Macias-Castillo

(10) Patent No.: US 10,500,516 B1
(45) Date of Patent: Dec. 10, 2019

(54) BURSTABLE BALLOON ENTERTAINMENT DEVICE

(71) Applicant: Uriel Macias-Castillo, Oxnard, CA (US)

(72) Inventor: Uriel Macias-Castillo, Oxnard, CA (US)

( * ) Notice: Subject to any disclaimer, the term of this patent is extended or adjusted under 35 U.S.C. 154(b) by 0 days.

(21) Appl. No.: 16/439,969

(22) Filed: Jun. 13, 2019

(51) Int. Cl.
*A63H 37/00* (2006.01)
*A63H 27/10* (2006.01)

(52) U.S. Cl.
CPC ..... *A63H 27/10* (2013.01); *A63H 2027/1016* (2013.01); *A63H 2027/1033* (2013.01); *A63H 2027/1091* (2013.01)

(58) Field of Classification Search
CPC .... A63H 2027/1033; A63H 2027/1041; A63H 2027/1075; A63H 27/10; A63H 2027/1083; A63H 2027/1091; A63H 2027/1016
See application file for complete search history.

(56) References Cited

U.S. PATENT DOCUMENTS 1,283,095 A 10/1918 Cummiskey
1,471,886 A 4/1923 Dessau
1,727,706 A * 9/1929 Hitt ..... A63H 37/00 446/5
2,701,672 A * 2/1955 Glasco ..... A63H 27/10 141/313
3,092,388 A * 6/1963 Wagenheim ..... A63F 9/0204 273/380
3,685,825 A 8/1972 Dorazio
3,702,675 A 11/1972 Bajo
3,713,656 A 1/1973 Cooper
3,795,400 A 5/1974 Glass
3,861,684 A 1/1975 Gastin
4,092,798 A 6/1978 Oquita
4,167,078 A 9/1979 Oquita
4,169,593 A 10/1979 Wood
4,201,387 A 5/1980 Revermann
4,243,220 A 1/1981 Shelley
4,638,207 A 1/1987 Radice
4,704,934 A 11/1987 Nosrati
4,787,872 A 11/1988 Bajo
4,832,337 A 5/1989 Estrada
4,881,733 A 11/1989 Rehlkemper
4,932,915 A * 6/1990 Boris ..... A63H 27/10 446/220
5,117,344 A 5/1992 Perez
5,324,045 A 6/1994 Trawick
5,433,644 A * 7/1995 Cheng ..... A63H 37/00 446/183

(Continued)

*Primary Examiner* — Nini F Legesse
(74) *Attorney, Agent, or Firm* — Jafari Law Group, Inc.

(57) ABSTRACT

The invention is generally a burstable balloon entertainment device comprised of a burstable balloon filled with articles or party items such as toys, confetti, candy, and the like. The burstable balloon may be inflated using one or more hand-held pumps in fluid communication with an interior of the balloon, which are generally configured to pump air into the balloon so that the balloon eventually explodes once the inflation has reached a certain threshold. In exemplary embodiments, the burstable balloon will explode or burst once the balloon has sufficiently expanded so as to touch a balloon bursting device, which may include an extended rod having a protruding pointy or sharp tip.

20 Claims, 6 Drawing Sheets

(56) References Cited

U.S. PATENT DOCUMENTS

| | | | | |
|---|---|---|---|---|
| 5,536,194 | A | 7/1996 | Larsen | |
| 5,538,451 | A * | 7/1996 | Sherer | A63H 27/10 446/14 |
| 6,059,708 | A | 5/2000 | Armendariz | |
| 6,354,904 | B1 | 3/2002 | Grey | |
| 6,685,146 | B1 | 2/2004 | Sanchez | |
| 6,978,974 | B1 | 12/2005 | Marasco | |
| 7,134,665 | B2 * | 11/2006 | Holsten | A63F 9/00 273/458 |
| 7,367,862 | B2 * | 5/2008 | Tsai | A63H 5/04 446/220 |
| 7,648,059 | B2 | 1/2010 | Pavlu | |
| 8,789,565 | B1 * | 7/2014 | Wicken | A63H 27/10 141/237 |
| 8,876,574 | B2 * | 11/2014 | Bourdelaise | A63H 37/00 446/399 |
| 9,254,444 | B1 * | 2/2016 | Toomey | A63H 27/10 |
| 2006/0232014 | A1 | 10/2006 | Holsten | |
| 2006/0234595 | A1 | 10/2006 | Bell | |
| 2010/0246465 | A1 | 9/2010 | Diaz | |
| 2014/0273707 | A1 * | 9/2014 | Becker | A63H 33/00 446/4 |

* cited by examiner

BURSTABLE BALLOON ENTERTAINMENT DEVICE

TECHNICAL FIELD OF THE INVENTION

The present invention relates generally to entertainment devices, and more specifically, to a burstable entertainment device for parties, which may be inflated using multiple hand-held pumps, and which explodes to release its contents—typically candy or toys.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever. Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Party games or devices, such as piñatas, have been widely used as a form of entertainment for celebratory events, such as for children's birthday parties and the like, for many years and since the early sixteenth century. A piñata generally is comprised of cardboard, paper mâché, or other such material that can be easily punctured to release its contents, by use of a baseball bat, a stick, or other such object.

Paper mâché piñatas are the most typical type of piñata available for purchase, which construction usually comprises forming a support structure by rolling or wadding paper, or by forming a cardboard structure, and then strips of scrap paper such as newspaper can be dipped into a paste and layered over the support structure, so as to cover it completely. The structure is generally then left to dry, and once dry, the structure can be cut in half and the inner support structure may be removed, leaving a hollow structure. The two halves of the hollow structure are then glued together again and/or fastened with tape. Lastly, a hole can be created within the hollow structure, and candy, toys, or other objects can be inserted, and the hole taped or otherwise closed. The hollow structure can then be decorated using paint, colored paper, cardstock, or by other means.

A piñata functions by being filled with candy, toys, or any such object or treat typically suitable for children, and then by being hung by a string from a tree or other object having a sufficient height. Then, typically, children will use a baseball bat or a stick to strike the piñata until the structure of it is sufficiently punctured and breaks to release its contents, with the first person or child to break the piñata being the winner. Alternatively, children or persons may be blindfolded while attempting to strike the piñata, thereby increasing the difficulty of the piñata game. As yet another attempt to increase the difficulty of the piñata game, children may be blindfolded, spun around until somewhat dizzy, and then can attempt to strike the piñata.

Nevertheless, piñatas made of paper mâché may be too easily punctured, and therefore may not provide entertainment for a long duration of time. Additionally, as children are typically blindfolded and dizzy after spinning around when attempting to strike a piñata, such an action can result in injuries to multiple persons. Furthermore, the traditional piñata has been in existence for a particularly long time, and therefore its design may no longer be found interesting or novel as a form of entertainment for children.

Attempts to remedy the deficiencies of piñatas have been undertaken, such as for example the creation of a piñata having multiple ribbons attached to its structure, and wherein one of the ribbons is attached to the piñata's "door," and once pulled, the ribbon will open the door to release the contents of the piñata. However, such a method is still deficient, because it generally removes the element of explosion of the piñata, which thereby eliminates much of the entertainment provided. Additionally, the first ribbon pulled may be the ribbon to open the piñata, thereby resulting in a very short-lived duration of entertainment.

Therefore, there exists a previously unappreciated need for a piñata, or similar burstable device, which explodes by a mechanism that does not involve striking the piñata with a baseball bat or stick, so as to prevent injuries. Additionally, there exists a need to provide a burstable entertainment device that is more novel than the traditional piñata form.

Furthermore, there exists a need to provide a burstable entertainment device that will achieve the foregoing objectives, while still providing a long duration of entertainment. It is to these ends that the present invention has been developed.

SUMMARY OF THE INVENTION

To minimize the limitations in the prior art, and to minimize other limitations that will be apparent upon reading and understanding the present specification, the present invention describes a burstable balloon entertainment device comprised of a burstable balloon, which is inflated using one or more pumps, and which explodes to release its contents once the inflation has reached a certain threshold—for example, wherein the burstable balloon has sufficiently expanded so as to touch an extended rod having a protruding sharp or pointy tip, which causes the burstable balloon to burst.

Generally, the invention involves a novel type of piñata, or a burstable balloon entertainment device comprised of a burstable balloon filled with articles or party items such as toys, confetti, candy and the like. Typically, the burstable balloon filled with items may be inflated using one or more hand-held pumps in fluid communication with an interior of the balloon, which are generally configured to pump air into the balloon so that the balloon eventually explodes once the inflation has reached a certain threshold. Connecting each of the one or more pumps to the balloon, may include employing a housing that is adapted to receive the one or more pumps and includes a chamber and aperture configured to receive an opening of the balloon. In exemplary embodiments, the burstable balloon will explode or burst once the balloon has sufficiently expanded so as to touch a balloon bursting device, which may include an extended rod having a protruding pointy or sharp tip.

A burstable balloon entertainment device, according to some exemplary embodiments of the present invention, may include: a housing including a top end configured to hang from a structure, a chamber within walls of the housing, an aperture on a bottom end of the housing adapted to couple to a balloon filled with a plurality of party items, and at least one port in fluid communication with the chamber and the aperture; a balloon bursting device coupled to the housing; at least one tube coupled to the at least one port of the housing; and at least one pump coupled to the at least one tube, the at least one pump configured to: pump air into the chamber of the housing; inflate the balloon so that a surface of the balloon approaches the balloon bursting device with every subsequent pump; and burst the balloon when the surface of the balloon contacts the balloon bursting device, so that the plurality of party items fall out of the balloon.

A burstable balloon entertainment device, according to some exemplary embodiments of the present invention, may include: a housing including a top end configured to hang from a structure, a chamber within walls of the housing, an aperture on a bottom end of the housing, and at least one port in fluid communication with the chamber and the aperture; a burstable balloon filled with a plurality of party items coupled to the aperture on the bottom of the housing so that a top of the burstable balloon hangs below the housing; at least one tube coupled to the at least one port of the housing; and at least one pump coupled to the at least one tube, the at least one pump configured to: pump air into the chamber of the housing in order to inflate the burstable balloon; and burst the burstable balloon so that the plurality of party items fall out of the burstable balloon.

A burstable balloon entertainment device, according to some exemplary embodiments of the present invention, may include: a housing including a top end configured to hang from a structure, a chamber within walls of the housing, an aperture on a bottom end of the housing, and a plurality of ports situated along the walls of the housing, the plurality of ports in fluid communication with the chamber and the aperture; a burstable balloon filled with a plurality of party items coupled to the aperture on the bottom of the housing so that a top of the burstable balloon hangs below the housing; a balloon bursting device coupled to the housing, including a sharp end suspended below the aperture of the housing configured to contact a surface of the balloon when the balloon is inflated to a bursting threshold; a plurality of tubes coupled to the plurality of ports of the housing; and a plurality of pumps coupled to the plurality of tubes, each of the plurality of pumps independently configured to: pump air into the chamber of the housing; inflate the balloon so that a surface of the balloon approaches the balloon bursting device with every subsequent pump; and burst the balloon when the surface of the balloon contacts the balloon bursting device, so that the plurality of party items fall out of the balloon.

The present invention therefore provides a burstable balloon entertainment device comprised of a balloon, which is inflated using multiple hand-held pumps supplying air through multiple tubes, and which explodes to release its contents once the inflation has reached a certain threshold, such that the balloon has sufficiently expanded so as to touch an extended rod having a protruding pointy tip, which causes the balloon to burst.

Various objects and advantages of the present invention will become apparent from the following description taken in conjunction with the accompanying drawings wherein are set forth, by way of illustration and example, certain embodiments of this invention. The drawings submitted herewith constitute a part of this specification, include exemplary embodiments of the present invention, and illustrate various objects and features thereof.

BRIEF DESCRIPTION OF THE DRAWINGS

The inflatable burstable balloon entertainment device with pump mechanism as disclosed herein is further described in terms of exemplary embodiments. These embodiments are described in detail with reference to the drawings, which have not necessarily been drawn to scale, in order to enhance their clarity and improve understanding of the various embodiments of the invention. Furthermore, elements that are known to be common and well understood to those in the industry are not depicted in order to provide a clear view of the various embodiments of the invention. These embodiments are non-limiting exemplary embodiments, in which like reference numerals represent similar structures throughout the several views of the drawings. The drawings that accompany the detailed description can be briefly described as follows.

DETAILED DESCRIPTION OF THE INVENTION

Figure 1:
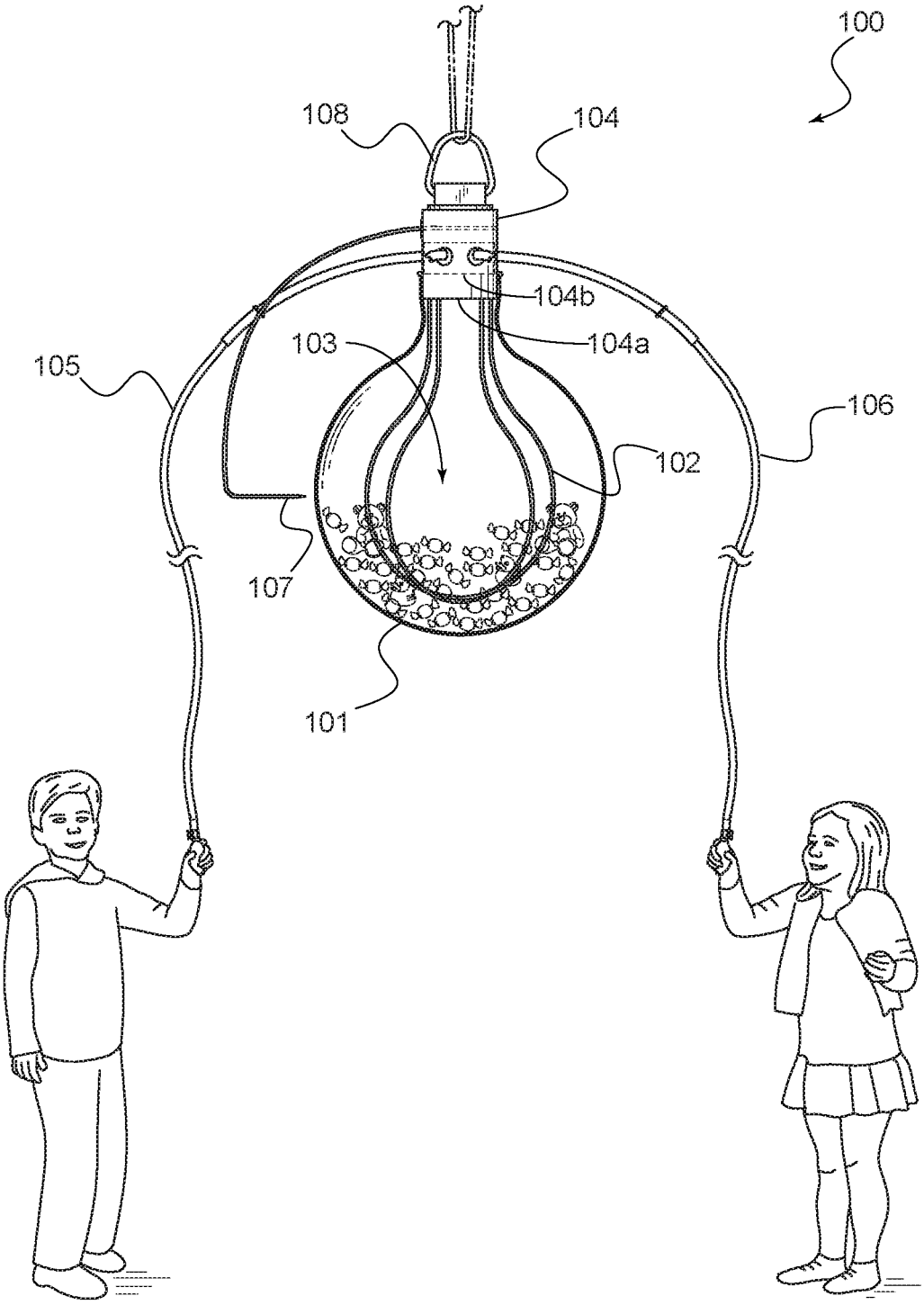
FIG. 1 illustrates a perspective view of an exemplary embodiment of the burstable balloon entertainment device and its usage.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized, and changes may be made without departing from the scope of the invention. Wherever possible, the same reference numbers are used in the drawings and the following description to refer to the same or similar elements.

In the following detailed description, numerous specific details are set forth by way of examples in order to provide a thorough understanding of the relevant teachings. However, it should be apparent to those skilled in the art that the present teachings may be practiced without such details. In other instances, well known structures, components and/or functional or structural relationships thereof, etc., have been described at a relatively high level, without detail, in order to avoid unnecessarily obscuring aspects of the present teachings.

Throughout the specification and claims, terms may have nuanced meanings suggested or implied in context beyond an explicitly stated meaning. Likewise, the phrase "in one embodiment/example" as used herein does not necessarily refer to the same embodiment and the phrase "in another embodiment/example" as used herein does not necessarily refer to a different embodiment. It is intended, for example, that claimed subject matter include combinations of example embodiments in whole or in part.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and or steps. Thus, such conditional language is not generally intended to imply that features, elements and or steps are in any way required for one or more embodiments, whether these features, elements and or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present. The term "and or" means that "and" applies to some embodiments and "or" applies to some embodiments. Thus, A, B, and or C can be replaced with A, B, and C written in one sentence and A, B, or C written in another sentence. A, B, and or C means that some embodiments can include A and B, some embodiments can include A and C, some embodiments can include B and C, some embodiments can only include A, some embodiments can include only B, some embodiments can include only C, and some embodiments include A, B, and C. The term "and or" is used to avoid unnecessary redundancy. Similarly, terms, such as "a, an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

While exemplary embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the invention or inventions disclosed herein. Accordingly, the following detailed description does not limit the disclosure. Instead, the proper scope of the disclosure is defined by the appended claims.

The present disclosure relates to, among other things, an inflatable burstable balloon entertainment device with a pump mechanism. Exemplary embodiments of the present disclosure are described with reference to the drawings for illustration purposes and are not intended to limit the scope of the present disclosure.

In some exemplary embodiments, the housing is a cylindrical structure, and which protruding from the housing is an inner frame that supports a balloon in its deflated state. Thus, the balloon encapsulates the inner frame. Protruding from the housing is also an extended, curved rod, having a protruding pointy tip, which extends parallel to a surface of the balloon. The housing may also contain one or more valves that attach to multiple tubes. At the opposite end of the housing, each tube includes an attached hand-held pump (which in some exemplary embodiments may include its own valve), which supplies air to inflate the balloon when squeezed or pressure is otherwise applied. Once the balloon is inflated, its edge or surface of the balloon stretches out towards the protruding pointy tip. Eventually, the surface of the balloon contacts the protruding pointy tip, which punctures and therefore explodes the balloon. Because the balloon is preferably filled with party items, the party items are then dispersed or deployed from the exploded or burst balloon. The balloon may be filled with candy, toys, or other objects, before the balloon is attached to the base.

In some exemplary embodiments, the frame may mimic the shape of the balloon, which balloon may encapsulate the inner frame. The frame may be constructed of metal, plastic, or other materials. The frame may be constructed to form any shape desired, such as for example the shape of an animal, or other object to serve entertainment and decorative purposes. The frame's construction may serve to give the exterior balloon the desired shape. The exterior balloon which encapsulates the frame may also be constructed to form a particular shape, such as the shape of an animal or other object and may be constructed to retain its shape once the balloon is inflated. The exterior balloon may be formed of plastic, paper, cloth, or any other material that is capable of or suitable for retaining air and expanding, so as to be inflated when air is inserted.

The housing may also have attached a hook or handle at the top end, such that the burstable balloon entertainment device can be hung from a tree or other object.

The housing may have ports with or without valves, such that multiple tubes may attach to the ports. The tubes supply the air used to inflate the balloon encapsulating the inner frame of the burstable balloon entertainment device. The ports may comprise one-way valves, such that air does not escape from the balloon and back into the tube. Additionally, in exemplary embodiments, the valves may allow air to escape into or remain within the tubes, and the tubes may be configured such that the end of the tube opposite from the housing does not release air, so that the balloon may remain inflated.

Also attached to the housing of the inner frame may be an extending, curved rod, which has a protruding pointy tip, that does not touch or puncture the encapsulating balloon when the balloon is in a deflated state. A pump configured to draw and push air through a tube may be attached to the ends of the tubes that are opposite of the ends attached to the base of the inner frame. Squeezing or applying pressure to one or more pumps may therefore cause air to flow through the tube and into the balloon through the holes or valves within the base attached to the inner frame and balloon.

The pumps may receive pressure and therefore supply air to the balloon all at once. However, in exemplary embodiments, the pumps may receive pressure and supply air to the balloon one at a time. As the balloon's circumference expands by the air supplied from the pumps through the tubes, the balloon's edge nears the protruding pointy tip of the extended rod. Once the edge of the balloon touches the protruding pointy tip, the balloon will be punctured and therefore typically will pop and/or explode, thereby releasing its contents.

Turning to the figures, FIG. 1 illustrates a perspective view of an exemplary embodiment of the burstable balloon entertainment device. More specifically, FIG. 1 depicts a burstable balloon entertainment device, or device 100, which generally includes a balloon 101, a frame 102 that helps secure a plurality of articles or items, such as party items 103, a housing 104 that includes at least an aperture 104*a* (see also FIG. 6, for example) adapted to secure a portion of balloon 101 onto housing 104, and one or more tubes 105, 106 coupled to one or more pumps 111, 112 (see also FIG. 2) in fluid communication with an interior of balloon 101 through chamber 104*b* of housing 104 (see also FIG. 6, for example). In exemplary embodiments, coupled to or integral with a portion of housing 104, a balloon bursting device 107 may be implemented so as to facilitate exploding or bursting of balloon 101. In order to hang device 100 from a structure, for example a roof, hanger, rope, or any other indoor or outdoor structure suitable for hanging device 101, a hanging device 108 may be implemented without limiting the scope of the present invention.

Balloon 101 typically encapsulates frame 102 in embodiments in which frame 102 is employed as will be discussed further below. Generally, however, balloon 101 is filled with articles such as candy, toys, confetti, or generally items suitable for providing during entertainment events such as birthday parties, and the like or other celebrations. Balloon 101 is generally a burstable balloon that may be inflated to a certain threshold prior to bursting and releasing any articles or items such as party items 102 from within. In some exemplary embodiments, balloon 101 may be constructed to form a particular shape, such as the shape of an animal or other object. In some exemplary embodiments, balloon 101 may be constructed to retain its shape once the balloon is inflated. In some exemplary embodiments, balloon 101 may be formed of plastic, paper, cloth, or any other material that is capable of retaining air and expanding, so as to be inflated when air is inserted. Moreover, balloon 101 should be burstable and its construction should be suitable for safely bursting when reaching a threshold volume. In exemplary embodiments, balloon 101 has enough of an interior area to hold a plurality of articles as mentioned above. In exemplary embodiments, balloon 101 further comprises of an opening end that is large enough to fit around an aperture 104*a* of housing 104 as will be further discussed below. Moreover, an opening 101*a* of the balloon 101 should be wide enough or at least flexible enough so that it fits around walls of housing 104, which should be large enough and suitable to receive items that may be inserted in the interior portion of balloon 101. In some exemplary embodiments, balloon 101 is manufactured so that it maintains a particular shape such as a rounded shape even when it is deflated. In this manner, balloon 101 may be configured for easier bursting since users will encounter less resistance when pumping air into the interior of the balloon. Moreover, having a deflated balloon 101 that is shaped about a frame, may facilitate inserting items inside the balloon.

Frame 102 may be included in some exemplary embodiments of the present invention or may be excluded without limiting the scope of the present invention. Generally, frame 102 may serve as a support structure for the items that are temporarily stored within balloon 101, and more specifically so that the balloon 101 may be more easily secured with enough of an interior volume suitable for receiving the items that go inside the balloon. For example, also though shown slightly inflated and fully inflated in various figures, when balloon 101 is fully deflated, frame 102 may facilitate keeping an interior open so that when balloon 101 is coupled to or around aperture 104*a* of housing 104, a user may easily insert items into an interior f the balloon without having to partially inflate the balloon. Also, as mentioned above, in some exemplary embodiments, balloon 101 may be fabricated so that its deflated shape is substantially an open shaped similar to that of frame 101. In exemplary embodiments, frame 102 may help the items be dispersed in a more desirable fashion during the bursting of the balloon. Furthermore, in some exemplary embodiments, frame 102 may help secure some of the items so that they do not bounce around inside balloon 101 during travel or prior to setting up device 101 at, for example, a party. In exemplary embodiments, frame 102 may mimic the shape of a balloon, or may have other shapes suitable for securing items snuggly inside the balloon, yet not so secure that frame 102 prevents the items from falling out or being dispersed during the bursting of balloon 101. Frame 102 may be constructed of metal, plastic, or other material that is light weight, preferably inexpensive, and that is sturdy enough to support the items inside balloon 101. Of course, frame 102 may be constructed to form any shape desired, such as for example the shape of an animal, or other object to serve entertainment and decorative purposes. The construction of frame 102 may serve to give the encapsulating balloon 101 the desired shape.

Party items 103 may include any item suitable for traditional piñatas such as candy, toys, confetti, or other objects that may be desirably deployed during a celebration, party or event in which device 100 is desirably used. Preferably, these items are light weight an inexpensive. However, in some embodiments, items 103 may include other fun, more valuable items, including bills, coins that have monetary value. As such, a variety of items may be included for fun and entertainment purposes without deviating from the scope of the present invention. Typically, items 103 are placed inside balloon 101 prior to the balloon 101 being coupled or attached to the housing of device 100.

Housing 104 generally facilitates not only securing balloon 101, but also the delivery mechanism for supplying air to inflate balloon 101. To these ends, housing 104 may include at least one aperture 104*a* at the bottom of housing 104 that is configured or adapted to receive an opening 101*a* of the balloon 101 through which balloon 101 may be inflated. Moreover, housing 104 may further include a plurality of openings, or at least one or more ports, that are configured to deliver air into the housing 104. Accordingly, housing 104 includes ports 105*a* for fluidly communicating one or more tubes such as tube 105 and tube 106 with one or more pumps such as pumps 111 and 112 via the one or more ports 105*a* on the housing with an interior of the housing through the at least one aperture and thereby an interior of balloon 101.

As with traditional piñatas, it may be desirable to hang device 100 from a structure such as a roof in an interior of a room, or a support beam in an outdoor structure or any other structure so that the device 100 may hang a proper height so that upon bursting a desirable disbursement of items 103 may be experienced. To these ends, in order to facilitate hanging or placing device 100 at a suitable or desirable height from the floor, in exemplary embodiments, housing 104 includes a top end 108 configured to hang from a structure.

One or more pumps 111, 116 may be employed as mentioned above to inject or supply air into an interior of balloon 101 so that balloon 101 is inflated and ultimately burst. Generally, the one or more pumps 111, 112 are in fluid communication with the interior of balloon 101 via housing 104, and more specifically via tubes 105, 106 connecting the one or more pumps 111, 112 to the housing 104. The one or more pumps 111, 112 may receive pressure and therefore supply air to balloon 101 all at once. However, in exemplary embodiments, the pumps 111, 112 may receive pressure and supply air to the balloon 101 one at a time. To these ends, various valves (see FIG. 2) may be used within housing 104 to enable such more complicated means. In exemplary embodiments, the pumps of device 100 comprise of hand pumps as shown in FIG. 1-FIG. 6. In some embodiments, other electric pumps may be employed however without deviating from the scope of the present invention. Preferably, hand pumps are employed to make participants feel more immerse in the experience of bursting balloon 101, as typically having to manually pump and this inflate balloon 101 achieves much more desirable anticipation in participants. Any design of a pump suitable for all ages, including children, that may easily facilitate inflating the balloon in accordance with this invention may be implemented without deviating from the scope of this disclosure.

As the circumference of balloon 101 expands by the air supplied from the pumps 111, 112 through the tubes attached thereto, in some exemplary embodiments, balloon 101 may simply reach a threshold size and explode. However, in some exemplary embodiments, a balloon bursting device may be implemented. In such embodiments, as the inflating balloon's edge nears a protruding pointy tip or sharp end or otherwise some suitable bursting device surface configured to burst a balloon, a surface of the balloon 101 will ultimately contact the bursting device causing balloon 101 to burst or explode.

Balloon bursting device 107 may include any number of devices, shapes, forms, and structures that are configured to burst an inflatable, burstable balloon without deviating form the scope of the present invention. For example, balloon bursting device 107 may include a rod or wire with a sharp end, a blade, a pointy tip, a device that provides an electric shock, a device that provides a heated tip, or any other device that may be configured to cause a balloon to burst upon contact. In some exemplary embodiments, device 107 includes a wire extending from the housing 104 with a sharp end suspended below the aperture of the housing 104, and in proximity to balloon 101 configured to contact the surface of the balloon 101 when balloon 101 is inflated to a bursting threshold.

Hanging device 108 is generally any device suitable for hanging device 100 from a structure as mentioned above. In some exemplary embodiments, hanging device 108 may be a hook or handle or rope, or ring structure at the top of housing 104 such that the device can be hung from a tree, structure or other object. Moreover, in some embodiments, housing 104 may simply include openings on a top end of housing 104 so as to allow a rope, wire, or the like be threaded through. Accordingly, in some exemplary embodiments, hanging device 108 comprises a rope, string, wire or other flexible structure. In some embodiments, hanging device is removable or may be flexible or may be foldable so that a user may more easily access a top end or cap portion of housing 104 (see for example FIG. 5) in order to open the cap and insert items inside the balloon.

In exemplary embodiments, device 100 may be distributed to consumers as an all-in-one device that includes balloon 101 already filled with items 103 and coupled to housing 104. In some exemplary embodiments, balloon 101 may be provided separately so that a user may have several balloons that they fill and couple to housing 104 whenever they are ready to use that particular balloon. In some exemplary embodiments, consumers may have to go to stores to obtain pre-filled balloons. In some exemplary embodiments, consumers are provided with empty balloons for them to fill with the items they desire. As may be appreciated by a person of ordinary skill in the art, many variations may be possible without deviating or limiting the scope of the present invention.

Accordingly, in one exemplary embodiment, a burstable balloon entertainment device 100, may include: a housing 104 including a top end configured to hang from a structure, a chamber 104*b* within walls of the housing 104, an aperture 104*a* on a bottom end of the housing 104 adapted to couple to a burstable balloon 101 filled with a plurality of party items 103, and at least one port 105*a* in fluid communication with the chamber 104*b* of the housing 104; a balloon bursting device 107 coupled to the housing; at least one tube 105,106 coupled to the at least one port 105*a* of the housing 104; and at least one pump 111, 112 coupled to the at least one tube 105,106, the at least one pump 111, 112 configured to: pump air into the chamber 104*b* of the housing 104; inflate the balloon 101 so that a surface of the balloon 101 approaches the balloon bursting device 107 with every subsequent pump; and burst the balloon 101 when the surface of the balloon 101 contacts the balloon bursting device 107, so that the plurality of party items 103 fall out of the balloon.

Figure 2:
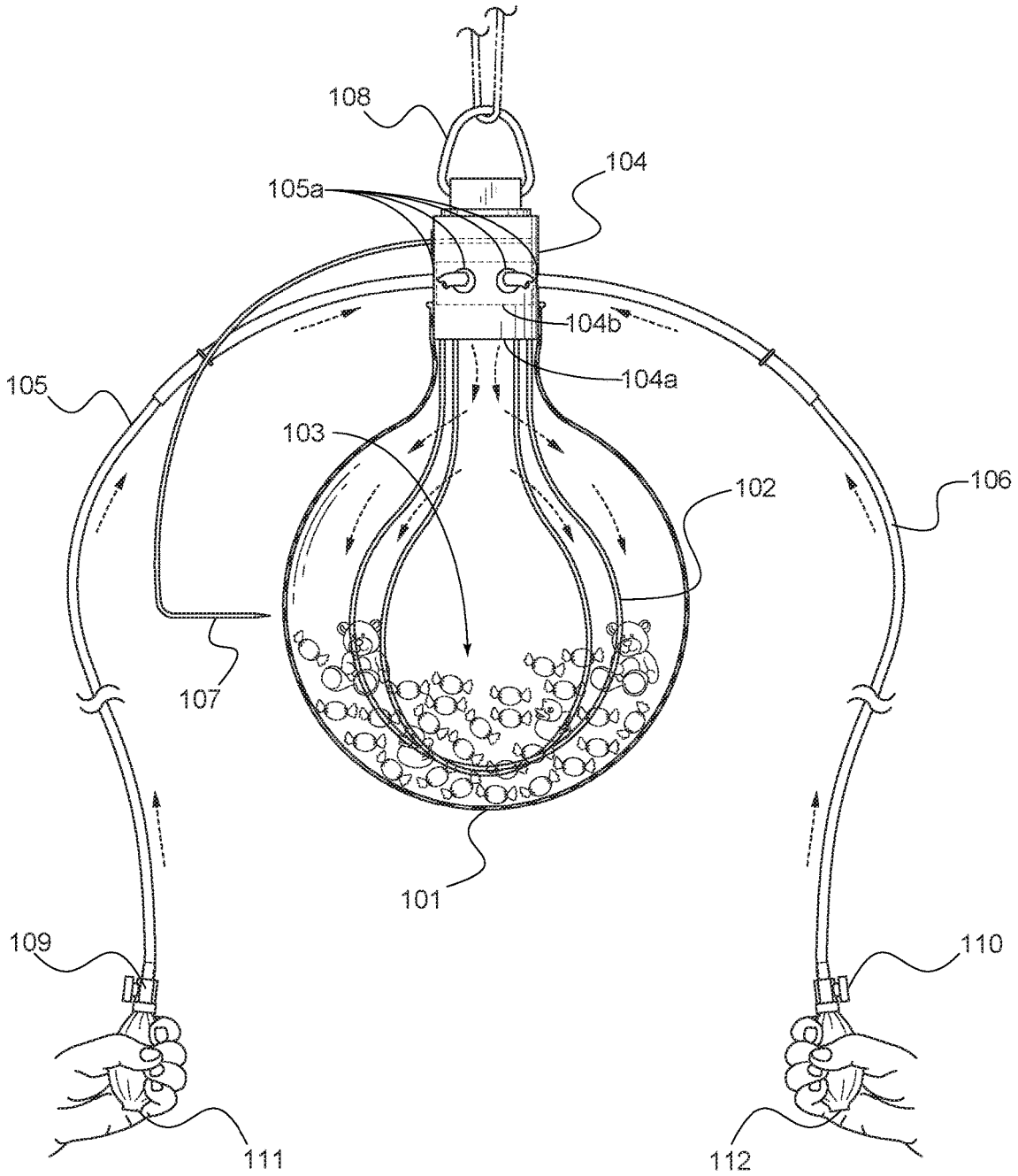
FIG. 2 illustrates a perspective view of the components of an exemplary embodiment of the burstable balloon entertainment device including a balloon and its method of inflation.

Turning now to the next figure, FIG. 2 illustrates a perspective view of the components of an exemplary embodiment of a bursting balloon entertainment device and its method of inflation. More specifically, this view depicts how hand-pumps 111 and 112 may be used by participants or users enjoying device 100; users may activate each hand pump 111 and 112 to inflate balloon 101 of device 100. From this view, it can be seen that the base structure or housing 104 may have a plurality of ports 105*a* comprising openings or holes that may include or employ valves therein, such that one of one or more tubes may couple to each port 105*a* of housing 104. As a person of ordinary skill in the art would appreciate, ports 105*a* and other components of device 100 (such as junctions between tubes, pumps, etc. will be air tight and to these ends may include O-rings, seals, or suitable devices that and or materials that ensures the fluid communications between these components are air tight so as to facilitate inflation of the balloon. The tubes supply the air used to inflate the balloon 101 encapsulating the inner frame 102 of the device 100. The valves 105*a* within the base or housing 104 may comprise one-way valves, such that air does not escape from the balloon and back into the tubes. Additionally, in exemplary embodiments, the valves 105*a* may allow air to escape into or remain within the tubes, and the tubes may be configured such that the end of the tube opposite from the housing 104 end does not release air, so that the balloon 101 may remain inflated. Moreover, pumps (111, 112) may also include their own valves 109 and 110.

In some exemplar embodiments, a burstable balloon entertainment device 100, according to some exemplary embodiments of the present invention, may include: a housing 104 including a top end configured to hang from a structure, a chamber 104*b* within walls of the housing 104, an aperture 104*a* on a bottom end of the housing 104, and at least one port 105*a* having a valve, the port 105*a* in fluid communication with the chamber 104*b*; a burstable balloon 101 filled with a plurality of party items 103 coupled to the aperture 104*a* on the bottom of the housing 104 so that a top (i.e. opposite of opening 101*a* of balloon 101) of the burstable balloon 101 hangs below the housing 101; at least one tube (105, 106) coupled to the at least one port 105*a* of the housing 104; and at least one pump (111, 112) coupled to the at least one tube (105, 106), the at least one pump (111, 112) configured to: pump air into the chamber 104*b* of the housing 104 in order to inflate the burstable balloon 101; and burst the burstable balloon 101 so that the plurality of party items 103 fall out of the burstable balloon 101.

In the current view of FIG. 2, it may be appreciated that balloon 101 is shown partially filled up. In the next view, however, balloon 101 is shown with a higher volume of air as it reaches a bursting threshold prior to bursting and deploying the items 103 therein.

Figure 3:
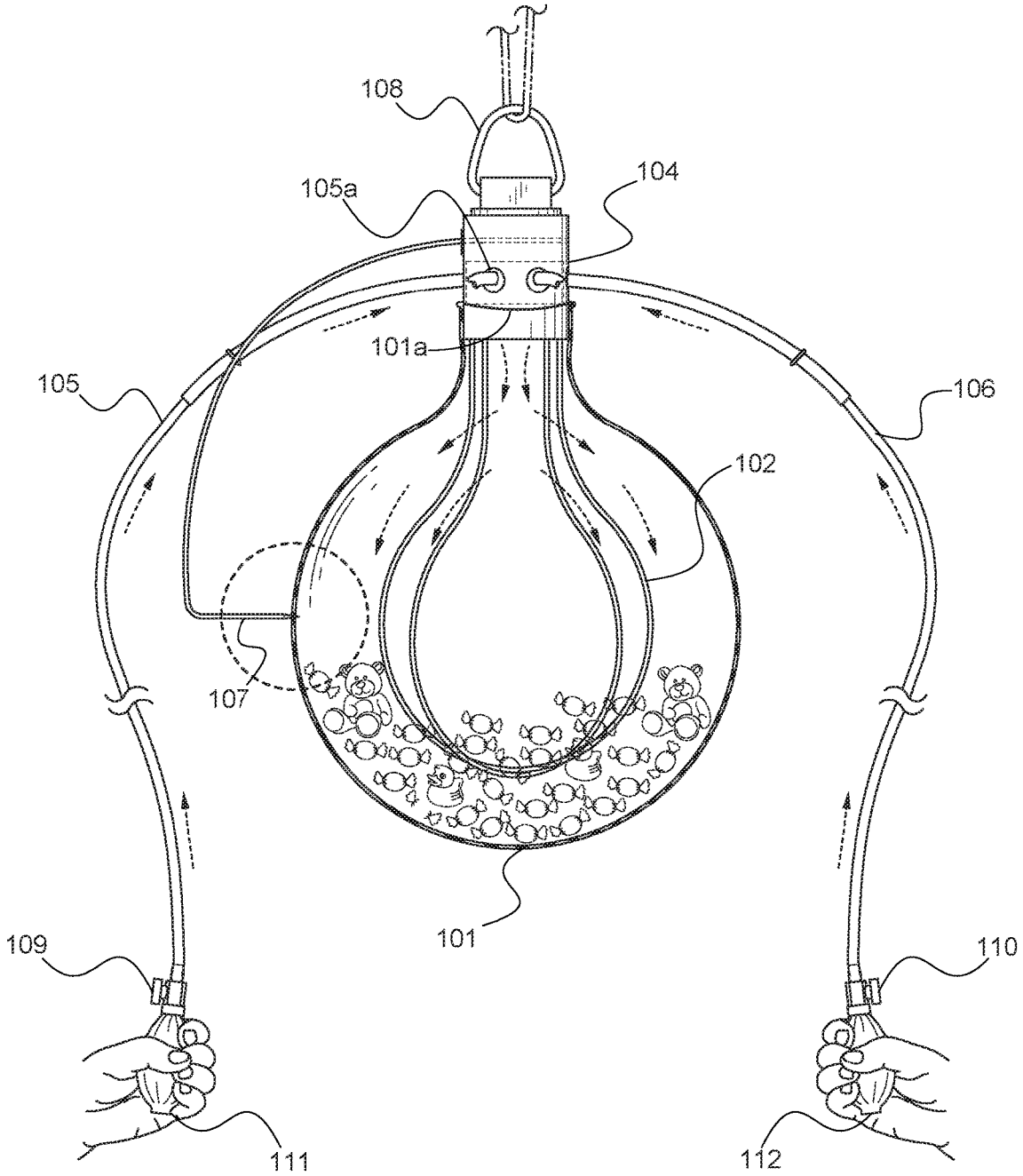
FIG. 3 illustrates a perspective view of the components of an exemplary embodiment of the burstable balloon entertainment device including a balloon and its method of puncture and explosion.

Turning now to the next figure, FIG. 3 illustrates a perspective view of the components of an exemplary embodiment of the device including a balloon and its method of puncture and explosion. From this view, balloon bursting device 107 just makes contact with a surface of balloon 101, which as will be shown in the following figure, ruptures or bursts balloon 101. From this view, it may be appreciated that in some exemplary embodiments, attached to the base structure or housing 104 may be an extending, curved rod which has a protruding pointy tip, that does not touch or puncture the encapsulating balloon 101 when the balloon is in a deflated state. Pumps 111, 112 are configured to draw and push air through a tube 105, 106 and may be attached to ends of the tubes 105, 106 that are opposite to the ends attached to housing 104. Squeezing or applying pressure to one or more of the pumps may therefore cause air to flow through the tube 105, 106 and into the balloon 101 through the valves within the housing 104 attached to the inner frame 102 and balloon 101. In some embodiments, pumps (111, 112) may also include their own valves 109 and 110. In some embodiments, housing 104 has no valves at ports 105*a*. Accordingly, various configurations and positioning of valves may be implemented in order to create different types of entertainment or games that may be enjoyed with device 100. For example, in one exemplary embodiment, only a single pump (say pump 111) may employ a valve 109, and there are no other valves within device 100. In such case, the user of that pump (111) may control whether air is released at any given time during inflation. Various game rules may be employed to make the experience last longer—such as 30 second intervals during which new users or players may part take in using the pumps. Cards, rules dice, or other game components could be added to dictate or control when and how or who gets to deflate the balloon 101 via the pump with a valve. Thus, various configurations may be implemented without deviating from the scope of the present invention, depending on rules or instructions that may be provided to users enjoying device 100.

Figure 4:
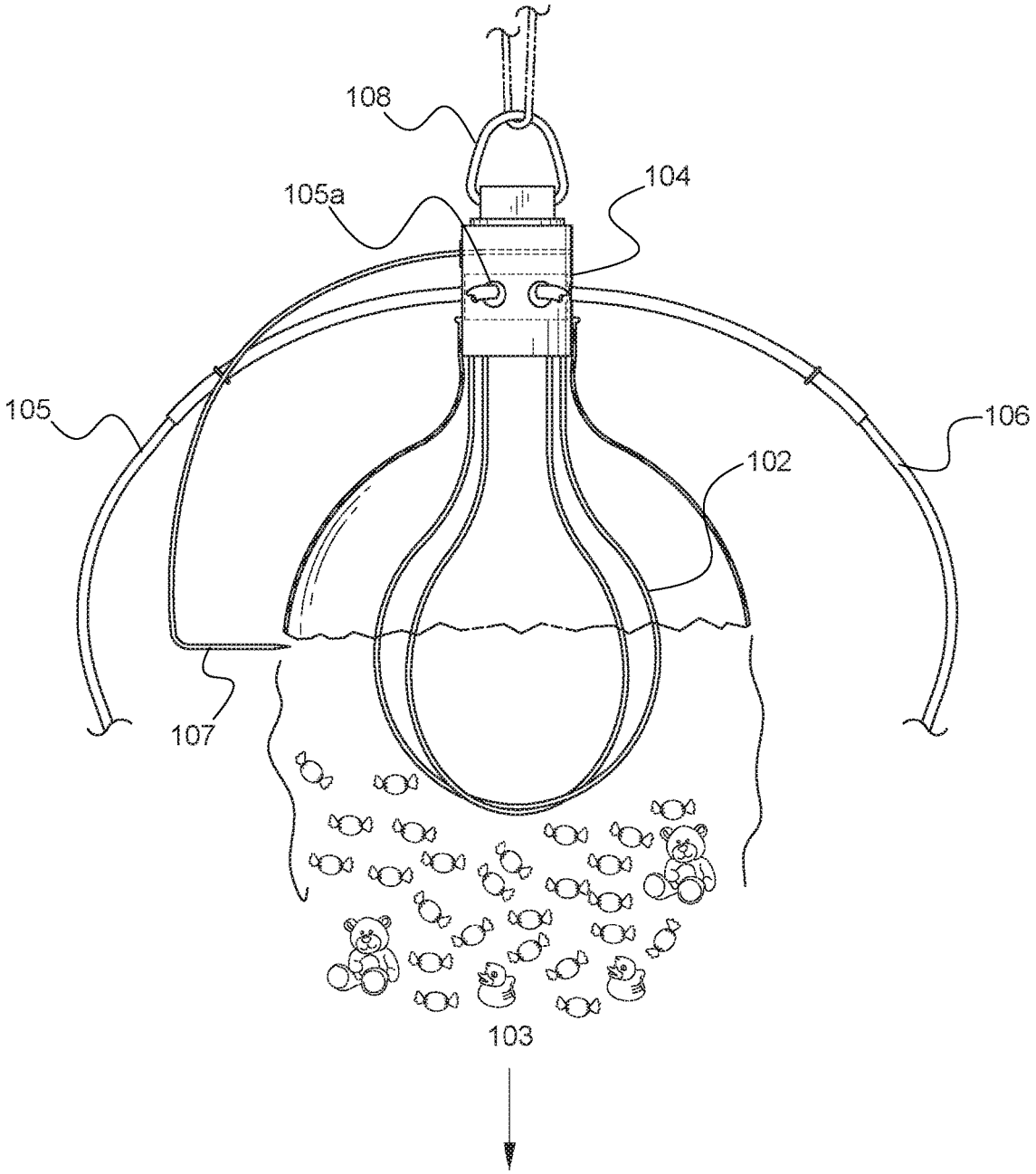
FIG. 4 illustrates a perspective view of an exploded balloon according to an exemplary embodiment of the burstable balloon entertainment device.

As may be appreciated in the following figure, FIG. 4 illustrates a perspective view of an exploded balloon 101 according to an exemplary embodiment of the device 100, once contact is made between a surface of balloon 101 and balloon bursting device 107. Upon bursting, party items 103 fall out of the balloon and are deployed so that users and others around device 100 may gather to pick up the desired items.

Figure 5:
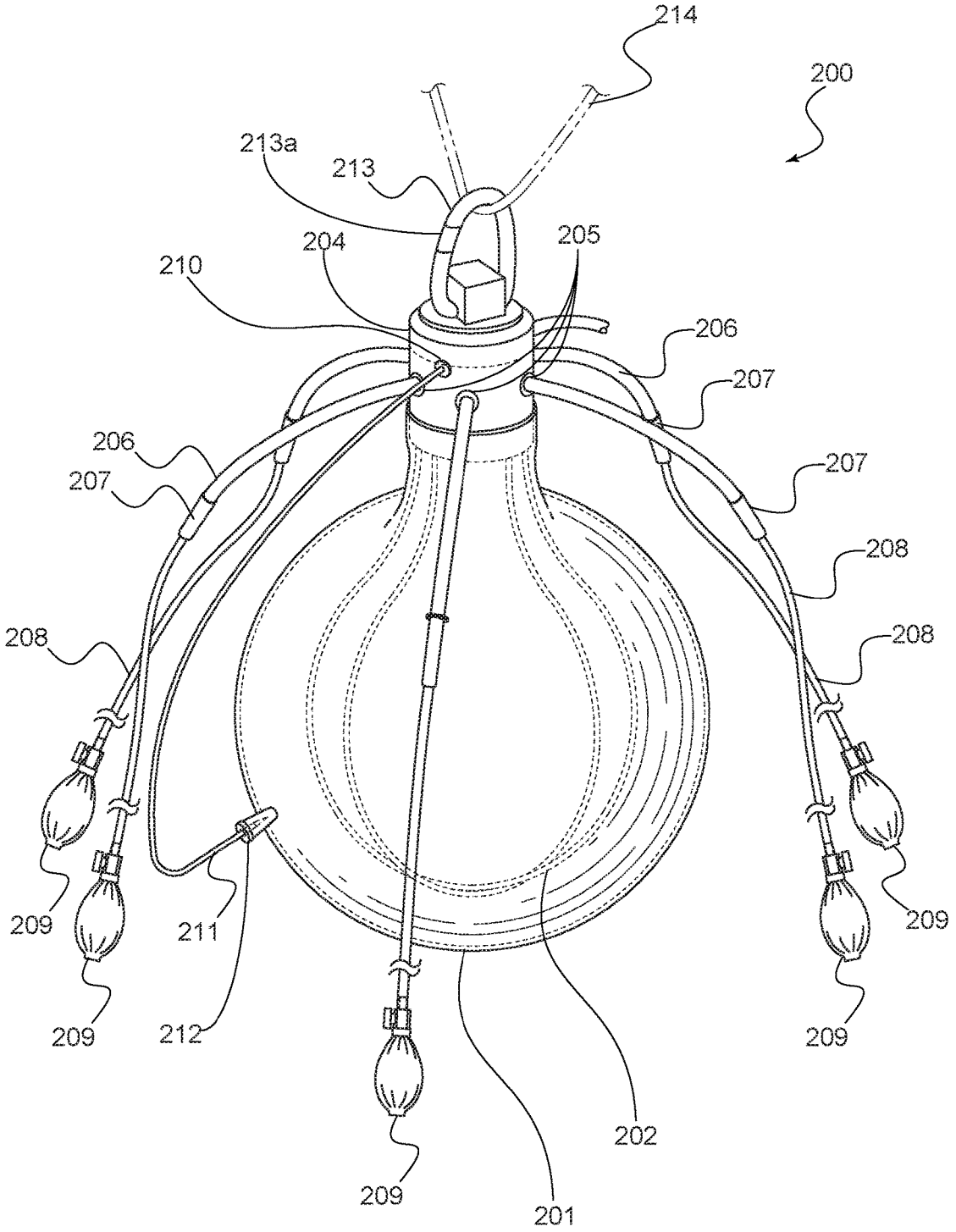
FIG. 5 illustrates a top-diagonal perspective view of an exemplary embodiment of a burstable balloon entertainment device.

Turning now to the next figure, FIG. 5 illustrates a top-diagonal perspective view of an exemplary embodiment of the present invention. More specifically, this view shows a burstable balloon entertainment device (device 200), comprising: a housing 204 including a top end configured to hang from a structure (via a hanging device 213), a chamber within walls of the housing 204, an aperture on a bottom end of the housing 204, and a plurality of ports 205 situated along the walls of the housing 204, the plurality of ports in fluid communication with the chamber and the aperture of the housing 204; a burstable balloon 201 filled with a plurality of party items (not shown in this view) coupled to the aperture on the bottom of the housing 204 so that a top of the burstable balloon 201 hangs below the housing 204; a balloon bursting device 211 (optionally including a cap 212) coupled to the housing 204, including a sharp end suspended below the aperture of the housing 204 configured to contact a surface of the balloon 201 when the balloon is inflated to a bursting threshold; a plurality of tubes 208 coupled to the plurality of ports 205 of the housing 204; and a plurality of pumps 209 coupled to the plurality of tubes 208, each of the plurality of pumps 209 independently configured to: pump air into the chamber of the housing 204; inflate the balloon 201 so that a surface of the balloon 201 approaches the balloon bursting device 211 with every subsequent pump; and burst the balloon 201 when the surface of the balloon contacts the balloon bursting device 211, so that the plurality of party items (not shown in this view) fall out of the balloon.

From this view, it may be appreciated that in some exemplary embodiments, the tubes may comprise an expandable tube or tube portion 208 coupled with couplers 207 to non-expandable tubes or tube portions 206. Such configuration may be desirable for creating a neat effect such as creating an expandable tube portion that expands when air is pumped via pumps 209. However, as this may make inflating the balloon more difficult, other nonexpendable tubes may be used. In some exemplary embodiments, the tubes coupled to the at least one port of the housing comprises a non-expandable tube from pump to housing. In some exemplary embodiments, the tubes coupled to the at least one port of the housing comprises a non-expandable tube portion and an expandable tube portion (as shown).

Figure 6:
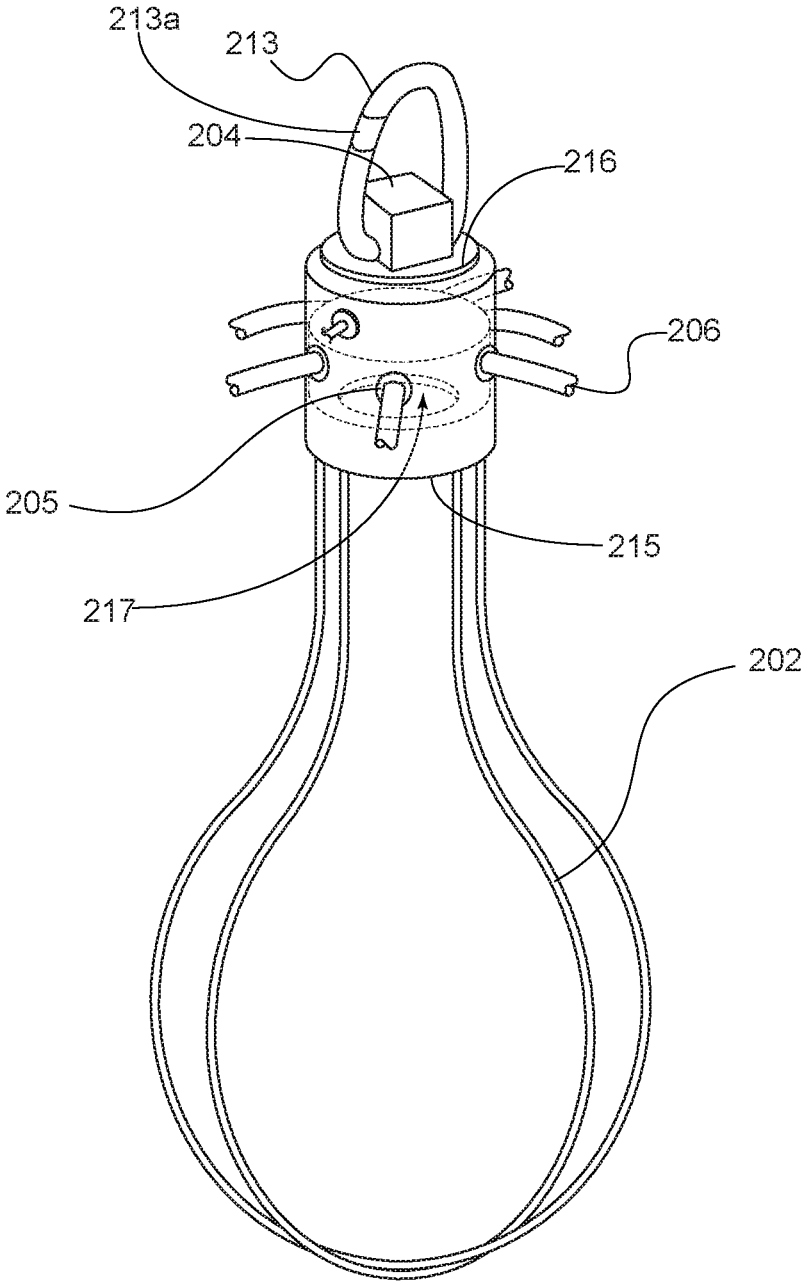
FIG. 6 illustrates a side-diagonal perspective view of an exemplary embodiment of a housing coupled to a frame of a burstable balloon entertainment device in accordance with the present invention.

Turning now finally to the last of the figures, FIG. 6 illustrates a side-diagonal perspective view of device 200, shown without balloon 201. From this view, it may be appreciated that housing 204 includes an aperture 215. A chamber 217 that can be seen in this see-through view, fluidly communicates the various pumps 209 via tubes 206 and ports 205 to an interior of balloon 201. In some exemplary embodiments, device 200 further includes a frame 202 configured to secure the plurality of party items inside the balloon 201 and to facilitate filling the balloon with items as discussed above. In some exemplary embodiments, device 200 further includes a removable top 216 at the top end of the housing 204 to provide access to the chamber 217 of the housing 204. In some exemplary embodiments, device 200 further includes a ring 213 coupled to the removable top 216 configured to hang the housing 204 from a structure. In some exemplary embodiments, ring 213 may include a releasable portion 213*a* to facilitate hooking and unhooking the device 200 from a structure.

A burstable balloon entertainment device with a pump mechanism has been described. The foregoing detailed description has set forth various embodiments of the devices and/or processes by the use of diagrams and/or examples. Insofar as such diagrams and/or examples contain one or more functions and/or operations, it will be understood by those within the art that each function and/or operation within such diagrams or examples may be implemented, individually and/or collectively, by a wide range of hardware, components, structures, or virtually any combination thereof.

Those skilled in the art will recognize that it is common within the art to describe devices and/or processes in the fashion set forth herein, and thereafter use engineering practices to integrate such described devices into other similar systems. That is, at least a part of the devices and/or processes described herein may be integrated into a burstable balloon entertainment device with a pump mechanism via a reasonable amount of experimentation.

The subject matter described herein sometimes illustrates different components contained within, or connected with, other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermediate components.

With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity.

A burstable balloon entertainment device with a pump mechanism has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

What is claimed is:

1. A burstable balloon entertainment device, comprising:
- a housing including a top end configured to hang from a structure, a chamber within walls of the housing, an aperture on a bottom end of the housing adapted to couple to a balloon filled with a plurality of party items, and at least one port in fluid communication with the chamber;
- a balloon bursting device coupled to the housing;
- at least one tube coupled to the at least one port of the housing; and
- at least one pump coupled to the at least one tube, the at least one pump configured to:
  - pump air into the chamber of the housing;
  - inflate the balloon so that a surface of the balloon approaches the balloon bursting device with every subsequent pump; and
  - burst the balloon when the surface of the balloon contacts the balloon bursting device, so that the plurality of party items fall out of the balloon.

2. The device of claim 1, further comprising a frame configured to secure the plurality of party items inside the balloon.

3. The device of claim 1, wherein the balloon bursting device includes a wire extending from the housing with a sharp end suspended below the aperture of the housing configured to contact the surface of the balloon when the balloon is inflated to a bursting threshold.

4. The device of claim 3, further comprising a cap removably coupled to the sharp end of the balloon bursting device.

5. The device of claim 4, further comprising a ring coupled to the removable top configured to hang the housing from a structure.

6. The device of claim 3, further comprising a cap removably coupled to the sharp end of the balloon bursting device.

7. The device of claim 1, wherein the at least one pump comprises at least one hand-pump.

8. The device of claim 1, wherein the housing includes a removable top at the top end of the housing to provide access to the chamber of the housing.

9. The device of claim 1, wherein the at least one tube coupled to the at least one port of the housing comprises an expandable tube.

10. The device of claim 1, wherein the at least one tube coupled to the at least one port of the housing comprises a non-expandable tube.

11. The device of claim 1, wherein the at least one tube coupled to the at least one port of the housing comprises a non-expandable tube portion and an expandable tube portion.

12. The device of claim 1, wherein the at least one pump comprises at least one hand-pump.

13. A burstable balloon entertainment device, comprising:
- a housing including a top end configured to hang from a structure, a chamber within walls of the housing, an aperture on a bottom end of the housing, and at least one port in fluid communication with the chamber;
- a burstable balloon filled with a plurality of party items coupled to the aperture on the bottom of the housing so that a top of the burstable balloon hangs below the housing;
- at least one tube coupled to the at least one port of the housing; and
- at least one pump coupled to the at least one tube, the at least one pump configured to:
  - pump air into the chamber of the housing in order to inflate the burstable balloon; and
  - burst the burstable balloon so that the plurality of party items fall out of the burstable balloon.

14. The device of claim 13, further comprising a balloon bursting device coupled to the housing.

15. The device of claim 14, wherein the balloon bursting device includes a wire extending from the housing with a sharp end suspended below the aperture of the housing configured to contact the surface of the balloon when the balloon is inflated to a bursting threshold.

16. The device of claim 13, further comprising a frame configured to secure the plurality of party items inside the balloon.

17. The device of claim 13, wherein the housing includes a removable top at the top end of the housing to provide access to the chamber of the housing.

18. The device of claim 17, further comprising a ring coupled to the removable top configured to hang the housing from a structure.

19. The device of claim 13, wherein the at least one tube coupled to the at least one port of the housing comprises a non-expandable tube or an expandable tube.

20. A burstable balloon entertainment device, comprising:
- a housing including a top end configured to hang from a structure, a chamber within walls of the housing, an aperture on a bottom end of the housing, and a plurality of ports situated along the walls of the housing, the plurality of ports in fluid communication with the chamber;

a burstable balloon filled with a plurality of party items coupled to the aperture on the bottom of the housing so that a top of the burstable balloon hangs below the housing;

a balloon bursting device coupled to the housing, including a sharp end suspended below the aperture of the housing configured to contact a surface of the burstable balloon when the balloon is inflated to a bursting threshold;

a plurality of tubes coupled to the plurality of ports of the housing; and a plurality of pumps coupled to the plurality of tubes, each of the plurality of pumps independently configured to:

pump air into the chamber of the housing;

inflate the burstable balloon so that a surface of the burstable balloon approaches the balloon bursting device with every subsequent pump; and burst the burstable balloon when the surface of the burstable balloon contacts the balloon bursting device, so that the plurality of party items fall out of the balloon.

* * * * *